US006329758B1

(12) United States Patent
Salam

(10) Patent No.: US 6,329,758 B1
(45) **Date of Patent: *Dec. 11, 2001**

(54) LED MATRIX DISPLAY WITH INTENSITY AND COLOR MATCHING OF THE PIXELS

(75) Inventor: Hassan Paddy Abdel Salam, London (GB)

(73) Assignee: Unisplay S.A., Geneva (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/366,726

(22) Filed: Aug. 4, 1999

Related U.S. Application Data

(63) Continuation-in-part of application No. 08/705,110, filed on Aug. 29, 1996, which is a continuation of application No. 08/575,067, filed on Dec. 19, 1995, now Pat. No. 6,081,073.

(30) Foreign Application Priority Data

Dec. 20, 1994 (GB) ..... 9425683

(51) Int. Cl.[7] ..... H05B 37/02

(52) U.S. Cl. ..... 315/169.2; 345/83

(58) Field of Search ..... 315/169.2, 158, 315/169.3, 169.1; 345/55, 76, 77, 82, 83

(56) References Cited

U.S. PATENT DOCUMENTS 5,594,463 * 1/1997 Sakamoto ..... 345/76
6,081,073 * 6/2000 Salam ..... 315/169.2

* cited by examiner

*Primary Examiner*—David Vu
(74) *Attorney, Agent, or Firm*—Dykema Gossett PLLC

(57) ABSTRACT

An LED color display matrix has first and second sets of LED lamps of first and second nominal color respectively. The actual colors of the lamps of the first set are not the same and this color mismatch is corrected for using the lamps of the second set.

36 Claims, 7 Drawing Sheets

LED MATRIX DISPLAY WITH INTENSITY AND COLOR MATCHING OF THE PIXELS

CROSS-REFERENCE TO RELATED APPLICATIONS

This is a Continuation-in-Part of U.S. application Ser. No. 08/705,110 filed on Aug. 29, 1996, now abandoned which is a Continuation of U.S. application Ser. No. 08/575,067 filed on Dec. 19, 1995, now U.S. Pat. No. 6,081,073.

BACKGROUND OF THE INVENTION

The present invention is concerned with enhancing the appearance of display matrixes in which each pixel comprises an LED lamp.

A problem in designing LED lamp matrixes is that of achieving uniformity so that all the lamps give the same light output. The light output of a new LED at a given temperature is dependent on its light efficiency, measured as light intensity at unit current, and on the operating current. Also LEDs are subject to intensity degradation, i.e. fading, with prolonged use.

For most types of LED lamp the light efficiency, often expressed in the form of luminous intensity at 20 mA, can vary from sample to sample by about 5:1. For some types, the diodes are sorted from the production line to have a lower ratio of maximum to minimum light efficiency form sample to sample, for example 2:1.

In an LED matrix with multiplexed drive, current is limited in each LED, usually by means of a resistor that is in series with the LED when it is turned on, and the matrix is preferably driven from a 5 volt supply to avoid reverse breakdown of the LEDs and to keep the power consumption low. The current, I, in a selected LED in such a case is given by:

$$I=(5-V_L)\div R_s$$

where $V_L$ is the forward voltage drop of the LED and $R_s$ is the value of the current limiting resistor. $V_L$ can vary from 1.8 to 3 volts for some types of LED, and using such types the current, I, can vary from a maximum value of $3.2/R_s$ to a minimum value of $2/R_s$, i.e. in the ratio 3.2:2. Thus if the initial light efficiency varies by 2:1, the light output can vary by 3.2:1. Added to this are variations in intensity degradation with time, and variations due to the differences in the voltage drops across the switches routing the currents to the LEDs.

Yet another factor affecting uniformity of an LED display matrix is that the junctions of the LEDs are not all at the same temperature. Those that are on, or have recently been on, are hotter than those that have been off. The difference between the hottest and the coolest junction temperature at any one time can be as much as 50 degrees centigrade. Since the light intensity of an LED can drop by 1% per degree centigrade, this represents a further 2:1 mismatch in intensity. The effect is dynamic. The time constants of junction temperature change can be of the order of a second for the LED itself and tens of seconds for its heat sink, which is typically its printed circuit board.

Not only are there intensity mismatch effects, but there are also color mismatch effects. LED lamps can be initially mismatched in color, when received from the manufacturer, by as much as 11 nanometers in wavelength for some green LEDs. Furthermore, LEDs are subject to dynamic color mismatch, due to dynamic temperature mismatch of the lamps. Further still, LEDs are subject to color degradation, i.e. change of color with prolonged use, which can itself cause color mismatch, since the lamps are not used equally and, in any case, are not guaranteed to have the same rate of degradation.

SUMMARY OF THE INVENTION

In the arts of television and photography an intensity mismatch ratio of 1.05:1 is established as discernible, as is a color mismatch, for green, of 0.7 nanometers. The above discussed variations in LED performance are much wider, and are thus a hindrance to achieving with LED matrixes images of a high quality. It is an object of the present invention to provide an LED display matrix in which all the lamps give the same light output, matched in color as well as in intensity, and free from the dynamic effects, and to achieve these results with a low-cost matrix drive system. It is a further object of the present invention to arrange that the display is as bright as possible in broad daylight, while keeping within the maximum current and junction temperature ratings specified by the LED manufacturer.

The present invention achieves the aforementioned objectives by providing a control system by which the performance the lamps is measured, in some embodiments with the aid of a video or digital camera, and the ambient light falling on the lamps is measured, and the ambient temperature of the lamps, also, is measured. These measurements are used by the control system to optimize the appearance of the display. In one embodiment the differences in light output between the lamps is minimized for all ambient light intensities up to a certain limit. Above this limit uniformity of lamp lighting is partially or wholly sacrificed to achieve maximum brilliance. The control system alters the brightness of each lamp individually by altering the proportion of time for which a register bit that selects the lamp is set. In one embodiment the brightness of the lamp is also dependent on a constant current circuit that delivers to the lamp a current that depends on the ambient temperature of the lamp.

In a further embodiment, for each pixel of a display, the color of a first lamp of the pixel is adjusted by turning on a second, different colored, lamp of the pixel, so as to match all the pixels in color. In yet another embodiment of the invention an electrical characteristic, such as the current, is measured continuously during display, for each lamp. This measurement is used to reduce mismatch between the lamps, in brightness and color, due to unequal temperatures of the lamps.

DESCRIPTION OF PREFERRED EMBODIMENTS

Figure 1:
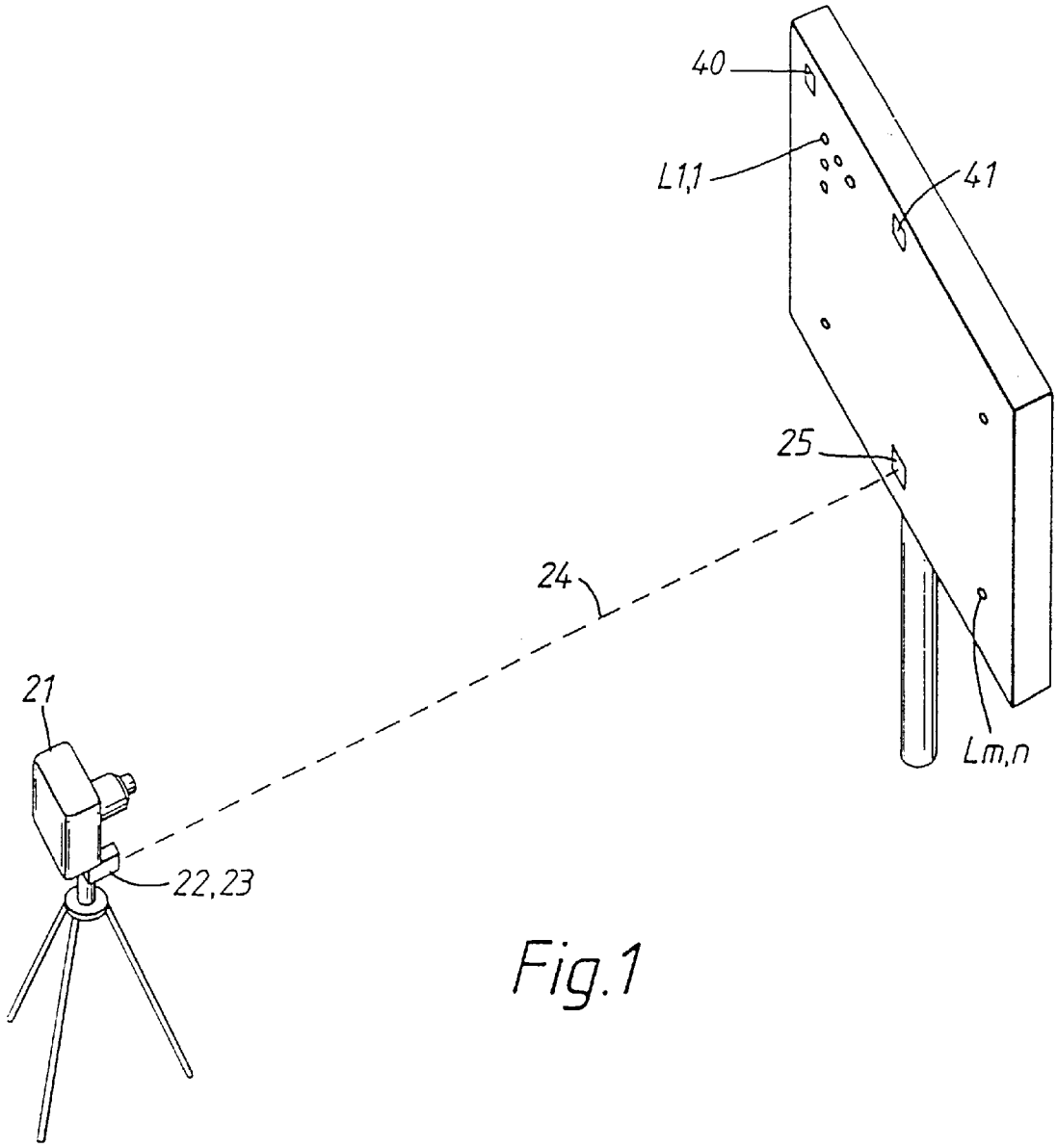
FIG. 1 illustrates setting up a lamp matrix display according to the invention.
Figures 2, 3A, 3B:
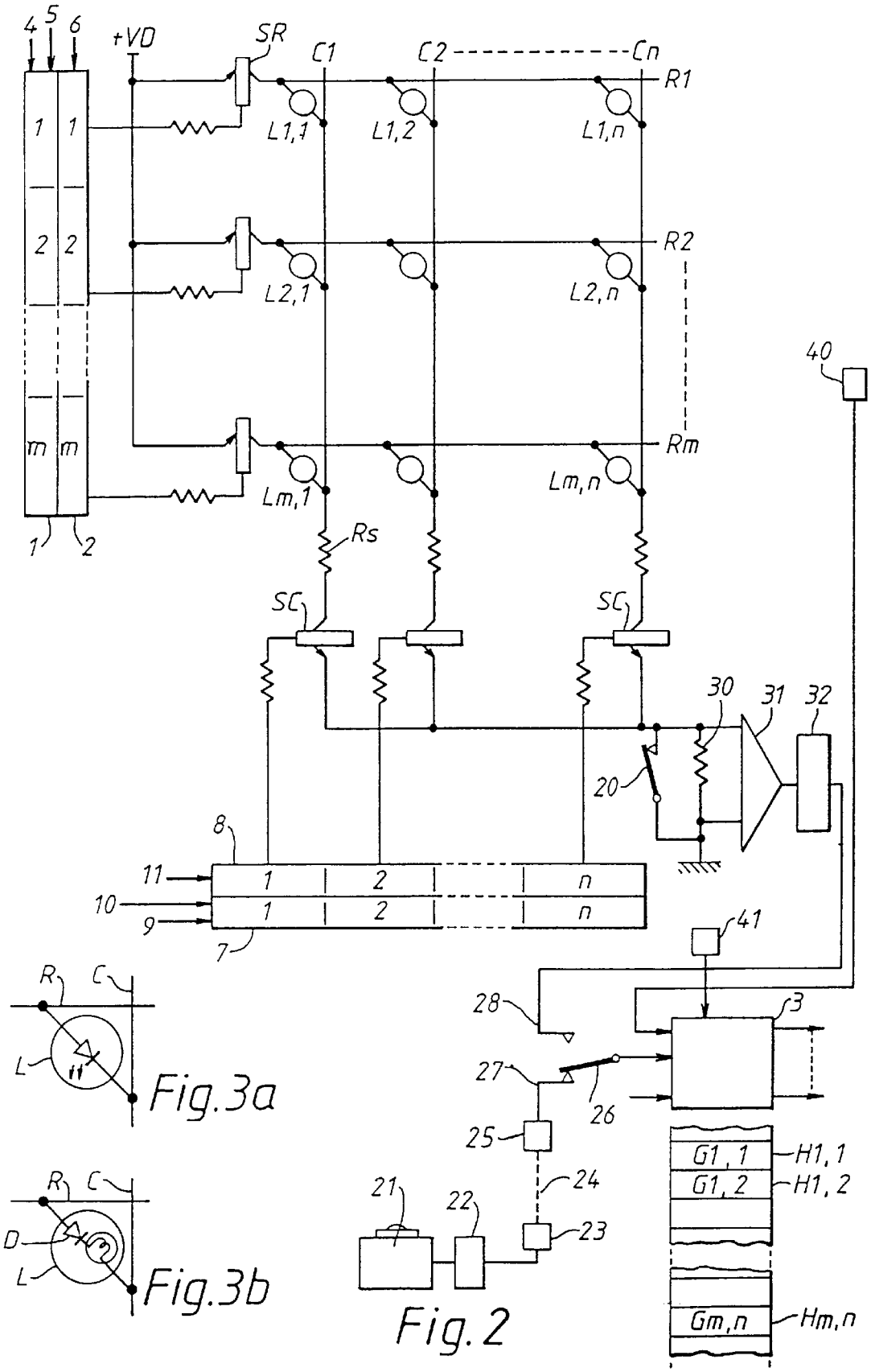
FIG. 2 illustrates the control of the display.
FIGS. 3*a*, 3*b* illustrate two kinds of lamp that can be used in the display.

FIGS. 1 and 2 illustrate an embodiment of the invention comprising a display matrix having m rows and n columns of lamps L. Lamp L comprises a light emitting diode the anode of which is connected to the row conductor R and the cathode to the column conductor C as illustrated in FIG. 3*a*. When a lamp L is energized it constitutes a luminous area. When lamp L is not energized it constitutes a dark area, by contrast with the luminous areas. The lamps are mounted on one or more panels not shown.

Information is displayed on the matrix by driving each row R, in turn, positively for a brief period $T_R$; the drive being repeated continuously in the order 1,2,3, . . . m, 1,2,3, . . . m, 1, 2, . . . and so on. Within the period $T_R$ that a row is driven, selected lamps L within the row are illuminated by turning on transistors SC of their associated column conductors C. $T_R$ may be of the order of 0.1 milliseconds.

A row is selected by setting its associated bit within parallel latch register 2 low and the remaining bits high causing the transistor switch for just that row to turn on. The data in register 2 is set up by microprocessor 3, which first loads the data into serial-in parallel-out shift register 1, and then strobes it into register 2 by applying a pulse to terminal 6. Data is loaded into register 1 by means of its serial data input 4 and its clock input 5. Registers 1 and 2 are each of m bits.

Selection of the columns also is under control of microprocessor 3. Microprocessor 3 loads serial-in parallel-out shift register 7 by means of data and clock inputs 9 and 10 respectively, and then transfers the data in register 7 to parallel latch register 8 by a pulse to strobe terminal 11. A column is selected, by its transistor switch SC, when its associated bit in register 8 is high. Current passes from the selected row through lamp L to the column switch SC and then to ground via closed switch 20. Register 8 has a ground terminal, not shown, which can be connected either to ground or to the emitters of transistors SC.

During selection period $T_R$ of a row, microprocessor 3 sets up register 8 256 consecutive times, at the rate of once every $T_A$ seconds, where $T_A=T_R/256$. This is to enable the brightness of each lamp, as perceived by the viewer, to be set to any one of 256 different values. The brightness to which a lamp is set to is dependent on a value of a parameter G particular to the lamp which is held in a location, H, in microprocessor memory that is, also, particular to the lamp. The value of G ranges from 1 to 255. For G=255 the lamp is turned on with maximum brightness as it is turned on for the whole of the row selection period TR. For G=1 the lamp is turned on with minimum brightness.

In general, microprocessor 3 controls the brightness of lamp $L_{x,y}$ (i.e. the lamp at row x, column y) by setting bit y of register 8 high for $G_{x,y}$ consecutive periods $T_A$ during the selection of row x, where $G_{x,y}$ is the value of G stored in memory location $H_{x,y}$ for lamp $L_{x,y}$. Thus the proportion of time for which a bit in register 8 is set to select a lamp determines the brightness of the lamp.

Apart from operating in the display mode described, the display of FIGS. 1 and 2 can also be set to one of two initialization modes, depending on the availability of a light sensing unit 21. If such a unit is used switch 26 is set to position 27 and switch 20 is kept closed. Light sensing unit 21 can be a video camera pointed at the matrix of lamps L. Lamps L are all turned on at maximum brightness by setting G equal to 255 for every lamp. The lamps are turned on briefly, for less than 0.1 seconds, so as not to heat them. The output of video camera 21 is transmitted to microprocessor 3 and the image of the matrix is stored in memory. Transmission from camera 21 to microprocessor 3 is with the aid of an analogue-to-digital converter 22 and infrared transmitter 23, which transmits the digitized image data over optical path 24 to infrared receiver 25. Receiver 25 is attached to the cabinet housing the matrix. Transmitter 23 is attached to the camera or its tripod and aimed at the receiver. Camera 21 may be a digital still camera, in which case converter 22 is not needed. The stored image is analyzed by microprocessor 3 to obtain brightness readings for all the lamps. The brightness readings are scanned by microprocessor 3 to determine which lamp L is the least bright, and the brightness of this weakest lamp is taken as a reference brightness. Following this, the brightness reading of each lamp is used by microprocessor 3 to set the G value for the lamp in its memory location H. The value of G being given by:

$$G=(255\times\text{Reference Brightness})\div\text{Brightness reading for the lamp}$$

The value of G is rounded to the nearest whole number. This completes the initialization process. The camera can be dispensed with and the system is ready for display, with all lamps appearing to have substantially equal brightness. The weaker lamps get more power than the stronger ones to achieve the uniformity. The proportion of time that a lamp is turned on, and therefore the power applied to it, is proportional to the value of G for the lamp.

initialization can be can be carried out periodically, for example once every year, to compensate for unequal fading of the LED lamps with use. To simplify the software that analyzes the information received from the camera, the procedure for measurement can be altered so that each lamp in turn is turned on by itself and a picture taken by the camera while the lamp is on. The pictures can be taken at the rate of several per second. The procedure can be altered so that the camera is pointed at only a quarter of the matrix at a time, if the resolution of the camera is low. To eliminate the effect of ambient light, which may appear as reflections off the face of the sign, on the reading for a pixel, the system can be arranged to measure the light from the pixel both when it is on and when it is off, and to take the difference as being the true reading.

As an alternative procedure, camera 21 can be connected to a laptop computer the display screen of which shows the image viewed by the camera. The laptop computer is used to analyze the light intensities of the pixels and to compute the G values, which are later sent to the display for storage in memory compartments H. Transfer of the G values can be by recording them on a medium which is subsequently read into memory H.

As another alternative, an ordinary film or Polaroid camera can be used for setting up the G values. Two photographs are taken, one with the lamps all on and the other with them off. The photos are analyzed, using a scanner to read them and a personal computer to work out the differences between the photographs and to compute the G values. The G value are subsequently transferred to memory H, which is preferably of the non-volatile type The display matrix may be a color one, where a pixel area can be set to any one of a wide range of different colors. In this case three LEDs are used for the pixel; one red, one green, and one blue. The three LEDs may be mounted behind a common diffuser. Alternatively they can be mounted close together so that when viewed at a distance the eye perceives the pixel area to be of only one apparent color, which is the sum of the three emitted colors. For pixel one of row one of the color matrix the three differently colored LEDs are wired as $L_{1,1}$; $L_{1,2}$; $L_{1,3}$ and for pixel two of row one they are wired as $L_{1,4}$; $L_{1,5}$; $L_{1,6}$ and so on along the row. Rows 2 onwards are wired using the same principle. During energization of a pixel, the durations for which its three associated bits in register 8 are set are made dependent not only on the G values, but also on other values held in memory that define the relative intensities of the three pixel lamps needed to achieve the required hue for the pixel.

Thus, a required light output $U_{rgb}$ for a pixel is achieved by driving its three LED lamps as follows:

$$\text{Red lamp: } N_r = G_r \cdot P_r$$

$$\text{Green lamp: } N_g = G_g \cdot P_g$$

$$\text{Blue lamp: } N_b = G_b \cdot P_b$$

where $N_r$, $N_g$, $N_b$ are the number of intervals $T_A$ during $T_R$ that the red, green, blue lamps are driven for, respectively; $G_r$, $G_g$, $G_b$ are the G values for the red, green, blue lamps, respectively; and $P_r$, $P_g$, $P_b$ are values, each not greater than one, held in memory, defining the amount of red, green, blue light, respectively, that the color pixel is required to generate. For example, if the color pixel is required to generate blue-green light at maximum intensity, then $P_r=0$, $P_g=1$ and P=1. It has been assumed so far that the red lamps are identical in color, and similarly with the green lamps and the blue lamps. The case where for one or more of the three colors the lamps are mismatched both in color and intensity will be discussed later.

During initialization It is possible, instead of using a camera as light sensor 21, to use a photo cell. In this case each lamp in turn is turned on with the photocell receiving light from it and the digital reading for the lamp light is recorded in microprocessor memory.

An alternative to initializing using a camera or a photocell is to measure the LED current, instead of its light output. In this case switch 20 is opened and switch 26 is set to terminal 28. Each lamp L is turned on in turn by selecting just its row and column conductors and a measurement of its current is made with the aid of resistor 30, which may be 1 ohm, and amplifier 31 and analogue-to-digital converter 32. The measurement is stored in a location of memory of microprocessor 3 associated with the lamp. After all the lamp currents have been measured and recorded the measurements are scanned to determine which lamp has the weakest current. This weakest current is established as a reference current. The microprocessor is then used to set up a value for G given by:

$$G = (255 \times \text{Reference Current}) \div \text{Current measured for the lamp.}$$

After setting up the G values switch 20 is returned to the closed position, ready for display. The system will now compensate for variations in lamp brightness caused by inequalities of the lamp voltage drops and by variations in the transistor voltage drops.

The system in FIG. 2 is arranged to dim all the lamps when the ambient light weakens. A light sensor 40 with digital output is arranged to measure the ambient light and transmit its digital value to microprocessor 3. For low values of sensed ambient light, for example at dusk or at night, microprocessor 3 introduces a time delay between driving each row and the next. This reduces the light output of the display but does not alter the relative brightnesses of the lamps, which are still controlled by the G values.

The lamps L in FIGS. 1 and 2 can each comprise several LEDs connected together in series, to give more power. Alternatively, they can be of another type than LED. For example they can be tungsten filament lamps. A simple way of selecting the tungsten lamps is to provide each with an ordinary diode D in series, as illustrated in FIG. 3*b*. The light output of tungsten lamps can fade with time. This is due to the formation of dark coatings on the inside surfaces of the bulbs after prolonged use, those bulbs that are turned on often becoming darker than those that are not.

Figure 4:
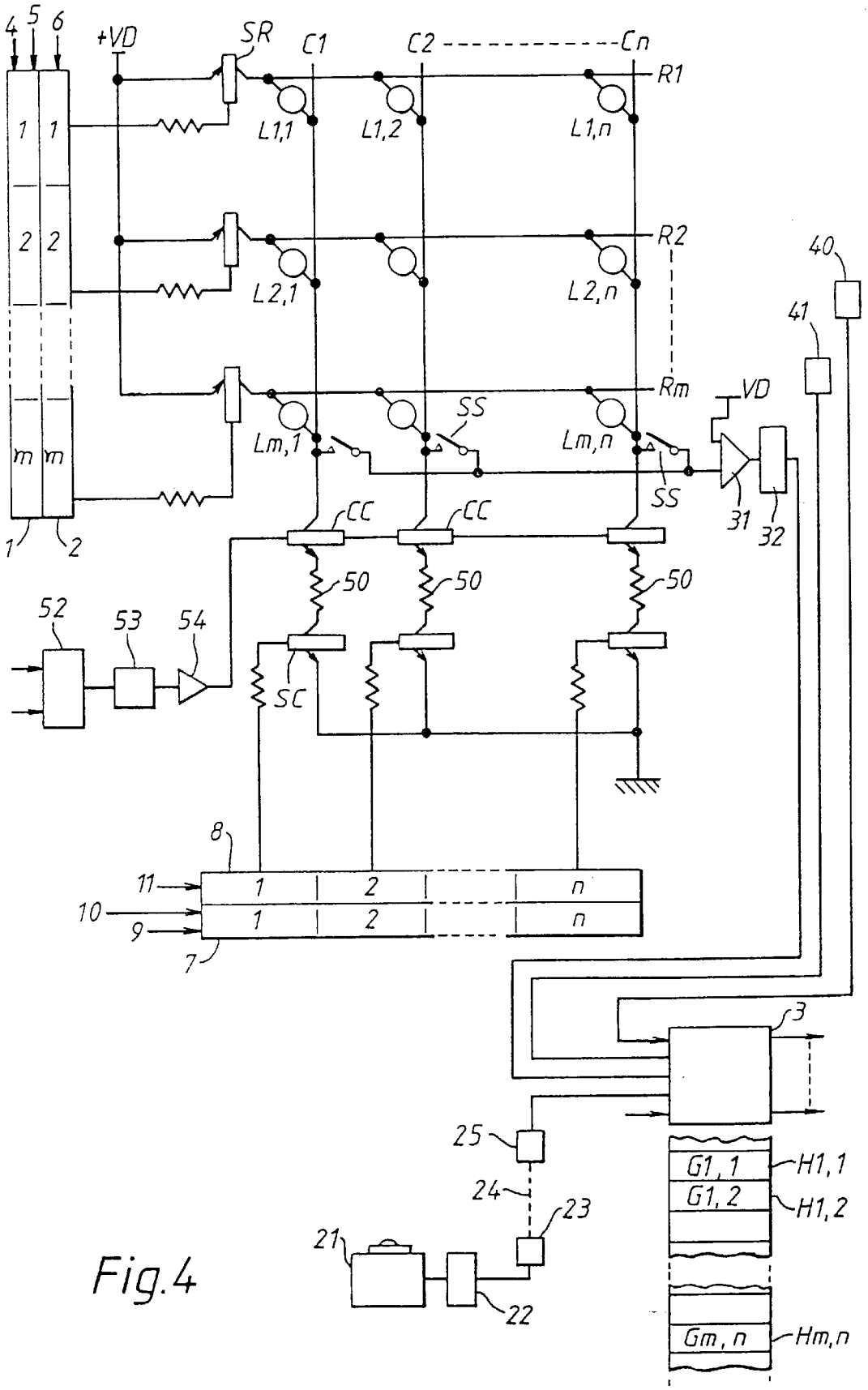
FIG. 4 illustrates an alternative control for the display.

FIG. 4 illustrates another embodiment of the invention. The operation of this with regard to matching the lamps by optical means is the same as that of FIG. 2. The lamps here are driven with constant current the magnitude of which is arranged to vary in accordance with the output of a temperature sensor 41. Temperature sensor 41 is mounted on the display so that it is subjected to the same ambient temperature as the LEDs. The ambient temperature of an LED is taken to mean the temperature of the LED when no electrical power is applied either to it or its neighbors. The output of temperature sensor 41, which can be digital, is fed to microprocessor 3.

Microprocessor 3 is arranged to set up a 4-bit register 52 in accordance with the measured temperature $t_a$. When $t_a$ is below a certain threshold temperature, $t_c$, equal, for example, to 50 degrees centigrade, the value in register 52 is set to fifteen. As the measured temperature $t_a$ rises above $t_c$, lower values than fifteen are set up in register 52 by microprocessor 3. The output of register 52 is fed to a digital-to-analogue converter 53, the output of which, in turn, is fed to a unity-gain power amplifier 54. Thus the voltage applied to the bases of transistors CC is controlled by microprocessor 3. When a column C is selected, its transistor CC together with the associated resistor 50 act as a constant current device delivering to the selected LED a constant current that is independent of the voltage drop across the LED and that is dependent on the output voltage of amplifier 54, and, so, adjusted in accordance with the sensed temperature $t_a$. The value of resistor 50 is chosen so that when register 52 is set to fifteen the LED current is the maximum allowed by the LED manufacturer. For sensed temperatures above $t_c$ the value in register 52 is set to the highest value for which the LED junction temperature will not go above a certain limit $t_u$, chosen not exceed the LED manufacturer's maximum junction temperature rating, which is typically 110 degrees centigrade. In this way the daytime brightness of the sign is automatically maximized while keeping within the LED manufacturer's maximum current and temperature ratings. As an example, microprocessor 3 can be arranged, when $t_a$ exceeds $t_c$, to set the contents Y of register 52 according to the formula:

$$Y = 15 - a \cdot (t_a - t_c)$$

where a is a constant of the order of 0.25.

Using camera 21, the arrangement in FIG. 4 can be set to give equal light outputs for all the lamps in the same way as was described in relation to FIG. 2. The arrangement compensates for the effect of variations of the constant currents from column to column, as well as the variations due to differing LED initial light efficiencies and variations that have occurred due to degradation.

In the arrangement in FIG. 2, if the lamps are of the LED type, microprocessor 3 can be arranged to reduce the proportion of time for which lamps L are turned on when the temperature sensed by sensor 41 is high, so as to prevent the LED junction temperatures from exceeding the manufacturer's rating. The reduction of the proportion of time can be achieved by introducing a delay between driving one row and driving the next, as was described before in relation to dimming the display at night.

In a further embodiment of the invention, applicable to both FIG. 2 and FIG. 4, microprocessor 3 is arranged to use light sensor 40 not only to dim the brilliance of the sign as darkness approaches, but also to increase the overall brilliance of the sign under conditions of extreme ambient light, such as strong sunlight falling directly onto the face of the sign. Microprocessor 3 is arranged, on detecting strong ambient light, to cease to drive the lamps so that they have equal light outputs and, instead, to drive each lamp either for the full period $T_R$, to achieve maximum brightness for the lamp, or for the maximum period for which the lamp brightness will not exceed that of any other lamp by a certain factor, for example 2. In this case uniformity is wholly or partially sacrificed in the interest of maximum overall brightness, but only when the ambient light is extreme. When the ambient light falls, microprocessor 3 reverts to setting the lamps equal in brightness.

In yet another embodiment, using either of the arrangements in FIGS. 2 and 4, the invention is arranged to provide a display that has pixels of matched color using LED lamps that are themselves not matched in color. The embodiment will be described with reference to an RGB color display matrix, on the basis that the green LED lamps are mismatched in color. In this embodiment, when for a color pixel only the color green, with an intensity factor $P_g$, is required, then instead of turning on just the green LED lamp for:

$$N_g = G_g \cdot P_g \text{ periods } T_A$$

during row selection time $T_R$, as described before, the control turns on the red lamp also, for:

$$N_{rgs} = G_r \cdot P_g \cdot Z_{rg} \text{ periods } T_A$$

where $Z_{rg}$ is a color correction factor for the green LED lamp, held in non-volatile memory specifying the proportion of red light that must be added to the light emitted by the green LED lamp to achieve green of the same dominant wavelength (i.e. the same perceived color) for all the pixels. Adding red light in this way matches all the pixels so that they have the same apparent color when they are turned on to green, when their lamps are at the same temperature.

During priming, a color camera, 21, is pointed at the display and the values of $G_r$ for the pixels are established, using the red channel of the camera for light measurement. Similarly, the values of $G_g$ are established using the green channel, and those of $G_b$ using the blue channel. Having equalized the lamps in intensity, the values of $Z_{rg}$ for the pixels are then established as follows. The green LED lamps are turned on, one at a time, several at a time, or all simultaneously, at the same light intensity, $W_{ge}$. For each pixel the intensity, $W_{rg}$, of red light emanating from the green LED lamp is measured, using the red channel of the camera, and recorded. The values of $W_{rg}$ are then scanned to find $W_{rg}(\max)$, corresponding to the pixel for which the green LED lamp generates the most red light. The color of this lamp is taken to be a reference color. For each pixel, the value of $Z_{rg}$ is evaluated by:

$$Z_{rg} = [W_{rg}(\max) - W_{rg}]/W_{ge}$$

and stored in non-volatile memory. By this expression all pixels turned on to green will emit light having the same proportion, $W_{rg}(\max)/W_{ge}$, of red to green light as the reference color.

In matching the pixels, a lamp of standard intensity and color, measured by the same means as the lamps of the matrix, can be used as the reference to which the lamps of the matrix are set instead of using selected lamps of the matrix as reference, or the reference may be just numeric information. In this way all displays made can be matched to a common reference.

The color correction system just described can be used to match in color the pixels of a monochrome display. Thus, for example, the pixels of a yellow LED monochrome display may each be provided with a red LED surrounded by a number of the yellow LEDs, the red LED being used to standardise the hue of the pixel in the manner described above, making all the pixels the same apparent shade of yellow when viewed from a distance.

If the LED lamps are subject to color degradation, i.e. change of color with use, the lamps may cease to be adequately matched in color after a time. Color mismatch due to color degradation can be reduced by repriming from time to time.

LED matrixes are subject to dynamic variations in the light intensities of the lamps caused by transient thermal effects as messages displayed are changed. As the temperature rises, the light output drops by a factor J. J can be of the order of 0.01 per degree centigrade for some LEDs.

As a further embodiment of the invention, the display system is arranged to correct for the dynamic variation by altering the drive to each LED lamp by a temperature dependent dynamic intensity factor:

$$E = 1/(1 - J \cdot \Delta t)$$

where $\Delta t$ is the change in temperature, t, of the lamp. The temperature of the lamp is the temperature at its junction.

Using the basic arrangement of FIG.2, the value of E for each lamp is determined by measuring its current, I, both during priming time, when the lamps are all at the same temperature tp, and during display, when the lamps are at different temperatures. This is explained as follows. Assuming switches SR, SC to be ideal switches, for example mosfet transistors with negligible "on" resistance, and neglecting the effect of measuring resistance 30, the current I of a selected lamp is given by:

$$I = (V_D - V_L)/R_s$$

where $V_L$ is the voltage across the lamp. The values of $V_D$ and $R_s$ are independent of temperature, and so, the change, $\Delta I$, of lamp current due to change, $\Delta t$, of lamp temperature is given by:

$$\Delta I/\Delta t = -(\Delta V_L/\Delta t)/R_s$$

For an LED lamp $(\Delta V_L/\Delta t)$ is a constant, B (equal approximately to −0.002 volts per degree centigrade), and so:

$$\Delta I/\Delta t = -B/R_s$$

from which:

$$\Delta t = -\Delta I \cdot R_s/B$$

and substituting this in the expression for E, one gets:

$$E = 1/(1 + \Delta I \cdot R_s \cdot J/B) \quad (1)$$

The procedure for evaluating and employing the correction factor E for each lamp, using the arrangement in FIG. 2, is as follows. As a prelude to priming, the display is blanked for a minute or more to allow all lamps L to reach the same steady temperature $t_p$. The G values are then established, for example using camera 21 as described before, taking care that the lamps are driven only briefly so as not to alter their temperatures. After the G values have been established, switch 20 is opened and switch 26 set to position 28 and each lamp L is turned on in turn, briefly so as not to alter its temperature, and its current, $I_p$, is measured and recorded in non-volatile memory. The temperature, $t_p$, at which the priming of the display has been carried out is read from sensor 41 and recorded in non-volatile memory. Switch 20 is preferably of the mosfet type.

During display, switch 26 is set to position 28 and the following procedure is carried out each time a row R is selected:

a) Switch 20 is opened and the current, I, of each lamp of the row is rapidly measured and temporarily recorded. This is done shifting a "one" along register 8. Because of the rapidity of measurement, the resultant light from the lamps is too weak to be seen.

b) For each lamp in the row, the value of E is calculated by microprocessor 3 from:

$$E=1/\{1+[I-I_p]\cdot R_s\cdot J/B\} \quad (2)$$

and temporarily stored. This expression is derived from equation (1).

c) Switch 20 is closed by microprocessor 3 and the row is driven for display with, for each lamp, the value A.E.G being used instead of G. By inclusion of the factor E, brilliance mismatch due to temperature differences between the lamps is now eliminated. The factor A is the same for all the lamps. A is chosen so that A.E cannot exceed unity. For example, it can be chosen to be 0.5.

By the above process, the light output is independent of both the ambient temperature and differences in temperature between lamps.

The value of J/B for a given LED can be determined at the end of priming by measuring the current $I_p$ and the brightness $W_p$ for the lamp at temperature $t_p$, then driving the lamp strongly for a few seconds to raise its (junction) temperature to some unknown value, $t_u$, and measuring the current $I_u$ and the brightness $W_u$ at this unknown temperature. The values are interrelated as follows:

$$1-W_u/W_p=J\cdot(t_u-t_p)$$

$$(I_u-I_p)\cdot R_s=B\cdot(t_u-t_p)$$

from which:

$$J/B=(1-W_u/W_p)/(I_u-I_p)\cdot R_s$$

The value for J/B is computed from this last expression. J/B can be determined and stored for each lamp individually.

As a modification of the above process, it is possible to allow the brightness of the display to diminish with ambient temperature rise while still eliminating lamp brightness variations that are due to lamp temperature differences. In this case the following value, E', is used in place of E in step (b) above:

$$E'=1/\{1+[I-I_p+(t_a-t_p)\cdot B/R_s]R_s\cdot J/B\} \quad (3)$$

where $t_a$ is the ambient temperature read from sensor 41 during display. The third term in the square bracket represents the effect on lamp current of changing the ambient temperature of the display from $t_p$ to $t_a$.

LED matrixes are subject to dynamic variations in the colors of the lamps, caused by the dynamic junction temperature changes The effect is more noticeable with certain green and yellow lamps. These shift their color towards red as the temperature rises.

An embodiment of the invention providing intensity matching, dynamic intensity matching, color matching and dynamic color matching will now be discussed for an RGB display using the arrangement in FIG. 2 and having three LEDs per color pixel, one for each color. It is assumed that color matching is required only for the green lamps. In this case a color pixel is driven as follows:

$$N_r=E_r\cdot A\cdot[G_r\cdot P_r+G_r\cdot P_g(Z_{rg}+Z_{rgd})]$$

$$N_g=E_g\cdot A\cdot[G_g\cdot P_g]$$

$$N_b=E_b\cdot A\cdot[G_b\cdot P_b]$$

where $E_r$, $E_g$, $E_b$ are the E values for the red, green and blue lamp of the pixel, respectively. The new term, $Z_{rgd}$, is a dynamic color correction factor, given by:

$$Z_{rgd}=(t_a+t_{mr}-t)\cdot Q$$

where $t_{mr}$ is a design allowance, for example 50 degrees, for the maximum expected temperature rise of the junction temperature above ambient, $t_a$, and where t, as before, is the lamp temperature. Q is a constant defining the change in the proportion of red to green light generated by the green lamp that occurs when its temperature rises one degree. As its temperature, t, rises, the green lamp generates more red but, by $Z_{rgd}$, the red lamp gives less red, keeping the proportion of total red to green independent of temperature. $Z_{rgd}$ can be re-expressed as:

$$Z_{rgd}=[(t_a-t_p+t_{mr})-(t-t_p)]\cdot Q$$

Since lamp temperature change $\Delta t$ is related to lamp current change $\Delta I$ by:

$$\Delta t=\Delta I\cdot R_s/B,$$

then $(t-t_p)$ can be replaced, to give:

$$Z_{rgd}=(t_a-t_p+t_{mr})\cdot Q-(I-I_p)\cdot Q\cdot R_s/B$$

from which:

$$Z_{rgd}=[(t_a-t_p+t_{mr})\cdot S\cdot B/R_s]-(I-I_p)\cdot S \quad (4)$$

where:

$$S=Q\cdot R_s/B$$

The value of S for a pixel can be determined at priming time by energizing the green lamp to determine its current, $I_p$, its green light, $W_{gp}$, and its red light, $W_{rgp}$, when its junction temperature is $t_p$; and then its current, $I_u$, its green light, $W_{gu}$, and its red light, $W_{rgu}$, when the junction is at higher temperature $t_u$. The value of S is computed from:

$$S=[W_{rgu}/W_{gu}-W_{rgp}/W_{gp}]/(I_{gu}-I_{gp})$$

and stored in non-volatile memory. The expression in the square bracket is the change in the proportion of red to green light between the two sets of measurements.

The value of $Z_{rgd}$ for a pixel is computed from equation (4). The factor in the square brackets in equation (4) is slow changing and can be evaluated once every minute. The other factor, $(I-I_p)\cdot S$, is computed every ten milliseconds or so, as is the value of $Z_{rgd}$.

The RGB display can be reprimed, once a year for example, to reduce unevenness due to color degradation, as well as unevenness due to intensity degradation.

The dynamic compensation described so far is applicable to displays for which the voltage-current characteristics of the lamps do not change significantly due to degradation that occurs between one priming time and the next.

If the lamps used are of a type that exhibits marked change of voltage-current characteristics with degradation then, to minimize the effect of degradation on the accuracy of dynamic compensation without having to prime frequently, the system is arranged to repeatedly test itself once every day at 3 AM. At this time the display is blanked for a minute or more to allow the lamps all to cool to the same temperature, $t_m$, given by temperature sensor 41. Temperature $t_m$ is recorded and the lamp current, $I_m$, is measured and recorded for each lamp. During subsequent display $I_m$ is used in place of $I_p$ in equation (2), or its alternative, equation (3), in step (b) of dynamic intensity correction. $I_m$ is also used in place of $I_p$ in equation (4) for the dynamic color correction factor $Z_{rgd}$. As a bonus, the system can in this case detect degradation in a lamp without rerpriming. The system compares $I_m$ with $I_p$ and if it is found that $$I_m < [I_p + (B/R)\cdot(t_m - t_p)]$$

then the internal resistance of the lamp has increased, indicating degradation. The brightness of the lamp can be turned up by the system by an amount dependent on the difference between the two sides of the equation so as to reduce differences in the brightnesses of the lamps that are due to inequalities in their degradations.

It is possible to provide dynamic compensation by measuring the lamp voltages instead of their currents, since $\Delta V = -\Delta I \cdot R_s$. In the arrangement in FIG. 4, by driving a lamp and closing switch SS of its column, the voltage of the lamp can be read, via amplifier 31 and analogue to digital converter 32. Switches SR and SS are in this case preferably of the mosfet type, having minimal voltage drop.

For each of the arrangements of FIG. 2 and FIG. 4 it is possible to replace camera sensor 21 with a single photosensor, such as a phototransistor, the output of which is fed to a tuned circuit, such as a one megacycle crystal, which feeds a demodulator. In this case, for measurements during priming, lamps L are energized only one at a time each with a pulse train of one million pulses per second.

Figure 5:
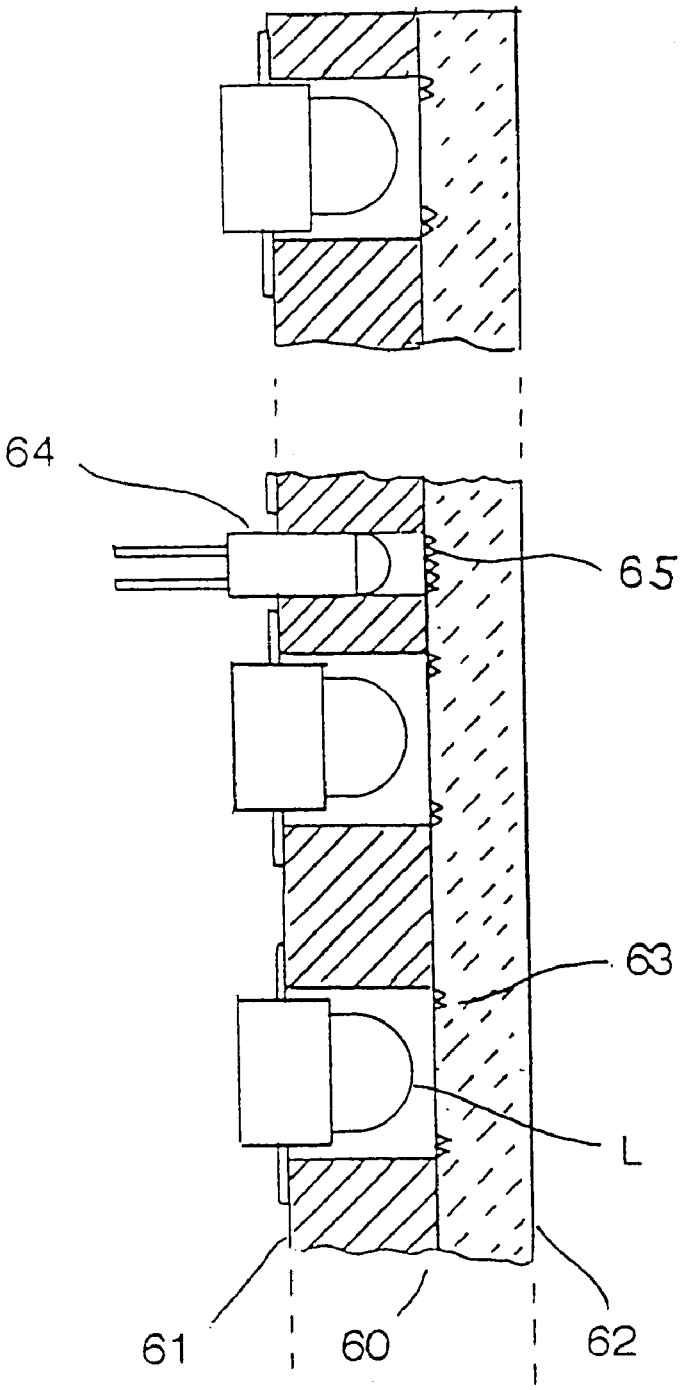
FIG. 5 illustrates in cross section an arrangement for sensing light from the lamps.

Lamps L may be mounted on tiles that are butted together, with each tile having, for example, a 16×16 matrix of lamps. Tile 60 illustrated in FIG. 5 includes lamps L soldered to the back of a printed circuit board 61 and a translucent light-guide sheet 62 mounted at the front of the board. Sheet 62 has a light disperser 63 opposite each lamp L and a light disperser 65 opposite a phototransistor 64 mounted at the center of the tile to receive light from sheet 62. Dispersers 63, 65 may comprise facets, grooves or roughened surfaces in sheet 62. The output of photosensor 64 is fed via suitable electronics to a filter that passes only one megacycle. At 3 AM each day the system is arranged to energize each lamp in turn at one million pulses per second and to measure the output of the filter circuit during such energization and to record the measurement and ascertain if there has been any change in the light output of the lamp due to degradation, relative to an earlier measurement made by the same procedure, and to correct for the detected change of light. Sensor 64 may be replaced with a fiber optic guide that transmits light from the tile to a sensor that is common to all of the tiles. Alternatively, each tile may be provided with two fiber optic guides each used to sense lamps on the tile that are not close to it. By this means, together with appropriate individual tailoring of each lamp disperser 63, it is possible to achieve sensing of the lamps that is fairly independent of lamp position on the tile, enabling the sensing system to be used for initial priming without having to use different multiplication factors to compensate for differences in light transmission between the lamps and disperser 65. The common sensor for all the fiber light guides can be a unit arranged to measure red, green and blue components of light separately.

Shift registers 1 and 7 can be replaced with gates arranged for rapid loading of drive registers 2 and 8 with bytes or words directly from microprocessor 3 or any external memory connected to it.

If the green lamps of an RGB display are severely mismatched in color then the amounts of red light needed to correct them can be large. This can result in unwanted intensity mismatch between pixels, since some of the pixels will have much more red energy added to them for color correction than others, making them brighter. The intensity mismatch caused by the color correction can be overcome by adjusting downwards the G values of the green lamps, each in accordance with the proportion of red light added for color correction of the green lamp. Thus, in this case the drive of a green lamp is dependent both on its efficiency in generating light and on its $Z_{rg}$ value.

It has been shown that red light can be added to the light of a green LED lamp to correct the light of the lamp towards red, using the correction factor $Z_{rg}$. Similarly, the light of the green lamp can be corrected towards towards blue by the addition of blue light, using a correction factor $Z_{bg}$·$Z_{bg}$ is the proportion of blue light that must be added to the light emitted by the green LED lamp for achieving same proportion of blue to green light for all the green LED lamps. The value of $Z_{bg}$ for each green LED can be determined at priming time using the blue channel of the color camera, in the same way as $Z_{rg}$ was determined for each green lamp using the red channel.

Some green LEDs are characterized by appearing somewhat white. The green light is not saturated. If such green LEDs are color matched using stored color correction factors $Z_{rg}$, $Z_{bg}$, the result will be that the matched green of the lamps will also have white light. The presence of white in the corrected green light is undesirable because it precludes displaying saturated or nearly saturated green, reducing the useful range of colors that can be displayed. According to a further embodiment of the invention each of the green lamps is provided with a filter that subtracts blue from the light of the green lamp. This has the effect of subtracting white light from the green light, making the green color more saturated. The filter can be yellow in color, for example yellow dye in the epoxy encapsulating a LED chip. The filter is preferably such as to increase the dominant color wavelengths of at least some of the green lamps by more than 3 nanometers.

Figure 6:
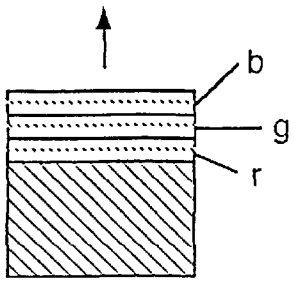
FIGS. 6–8 illustrate positional arrangements for LED light sources.
Figure 7:
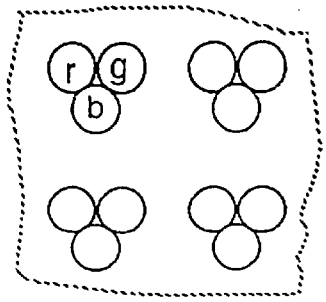
Figure 8:
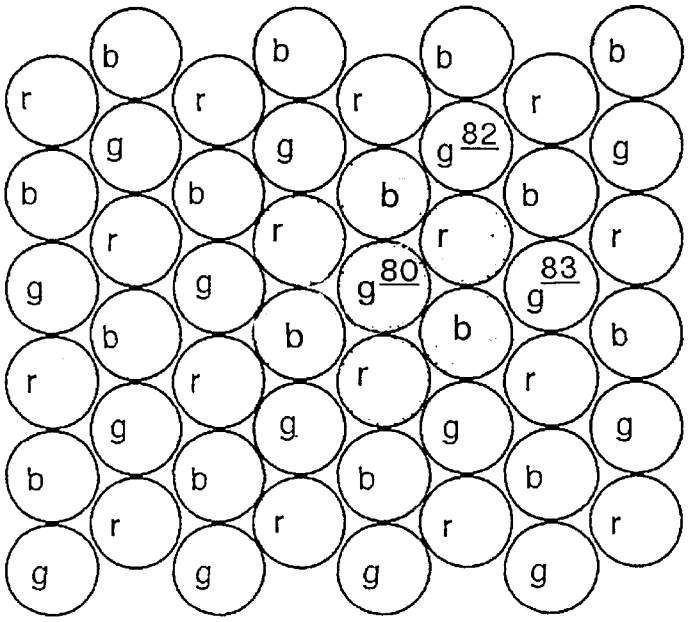
Figure 9:
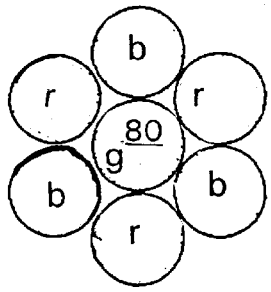
FIG. 9 is a detail of FIG. 8

FIGS. 6–9 illustrate some arrangements that can be used for positioning RGB LED light sources having correction according to the invention. In FIG. 6 the LED light sources consist of LED layer structures stacked sequentially on a substrate 70 to give output light of a mixed color. Layer structure r generates red light has as its neighbors layer structures b and g which generate blue and green, respectively. FIG. 7 shows a matrix of LED light sources each comprising a red (r), a green (g) and a blue (b) lamp. Yet another arrangement is shown in FIG. 8. A detail of FIG. 8 is shown in FIG. 9. It is assumed for simplicity that the green lamps give saturated light. It is seen that the green LED 80 is surrounded by three neighboring red LEDs. Color correction of the green LED 80 can be achieved by supplementing the green light of the LED with red light from one, two or all three of its neighboring green LEDs "r". If all three surrounding red LEDs are used for the color correction then each is arranged to provide only a third of the red light needed for correction of green LED 80. By using all three red LEDs as the light source for color correction of the green, the centre of the red correcting light coincides with the center of the green LED.

Looking at red LED 81 in FIG. 8, and assuming that each green LED is corrected using its three surrounding red LEDs, then LED 81 has to provide the red display light required of the display for position 81 plus, for each of its surrounding green LEDs 80, 82, 83, a third of the red light needed to correct the color of the LED. Thus there are four components of light that LED 81 must provide. The sum of the four components can be computed by microprocessor 3 for driving LED lamp 81.

If it is desired to define RGB pixel centers in the arrangement of FIG. 8, the pixel centers can be taken to be the centers of green LED lamps, or they can be taken as points each of which is surrounded by by an r, g, b trio.

Just as the apparent colors of green LED lamps of the matrix can be matched using supplementary red or red and blue light; so can the blue lamps be matched using supplementary green or green and red light. And so can the red lamps be matched, using supplementary green or green and blue light.. With the existing LED manufacturing technologies blue LED lamps typically need less correction than the green lamps, and red LED lamps need typically very little or no correction.

Figure 10:
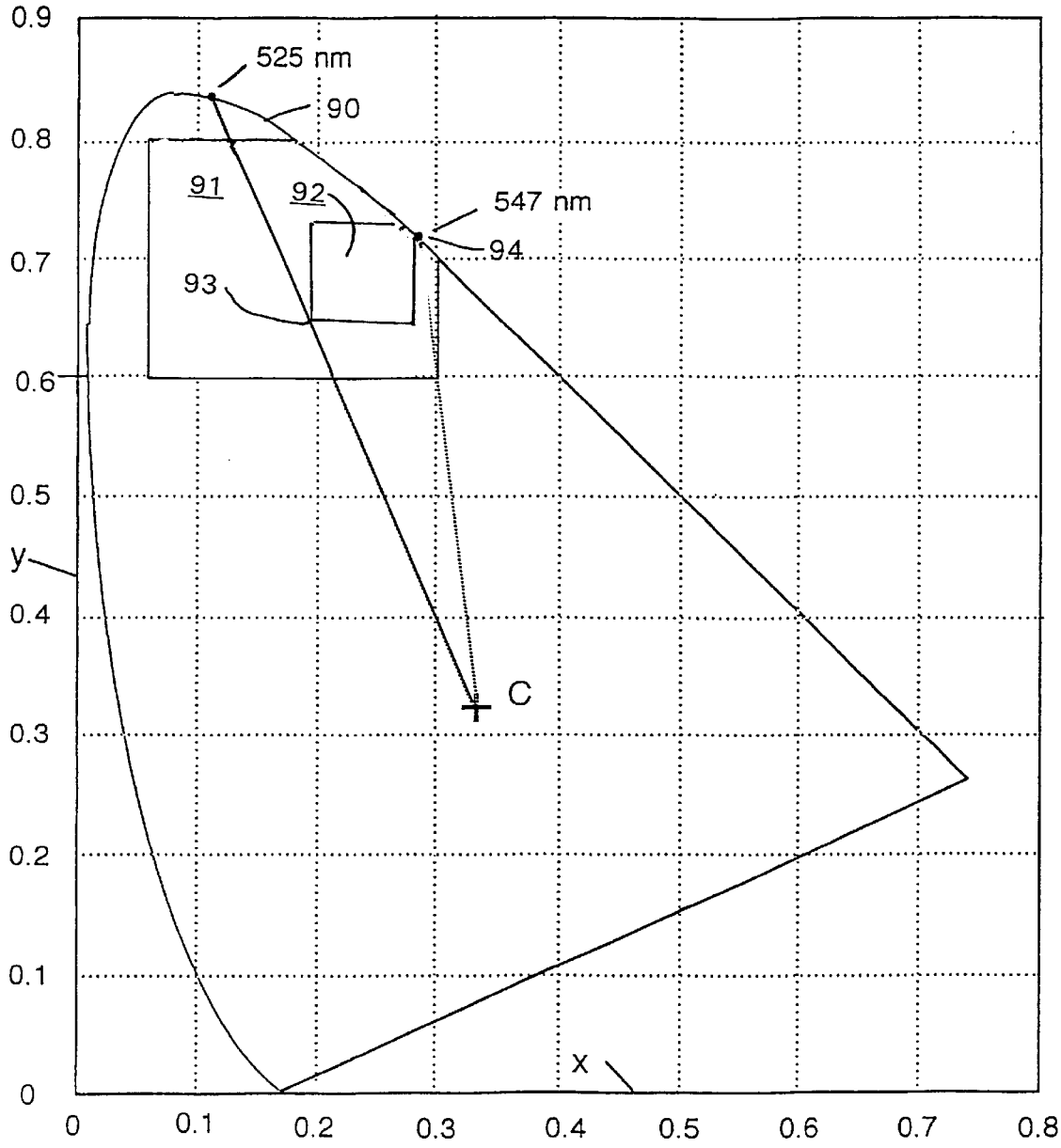
FIG. 10 illustrates color variations in batches of LED lamps.

FIG. 10 illustrates by dotted area 91 in the CIE 1931 (x, y) chromaticity diagram the range colors of green gallium nitride (GaN) lamps as they come off the production line. Dotted area 92 represents the range of colors of LEDs selected by the manufacturer from range 91 so as to have a better color match for display applications. The left hand side of area 92 is normal to the x-axis. The dominant color wavelength of a light source is defined as the the point on the spectrum locus 90 of the CIE diagram intersected by a line passing through a point "C" on the diagram, which represents white light, and the point on the diagram defining the color of the source. The dominant color wavelength of an LED having the color 93 in selected range 92 is illustrated to be to be 525 nanometers, and the dominant color wavelength of an LED of color 94 of area 92 is shown to be 547 nanometers. Thus the LEDs selected to be color matched have, in fact, dominant color wavelengths differing by as much as 22 nanometers. Furthermore, an LED at point 94 has saturated color, whereas an LED at point 93 has a large proportion of white. Thus the LEDs of area 92 will have markedly different appearances. The size of rectangle 92 can be reduced to lessen the mismatch of appearances, but this increases the cost of the LEDs, because the manufacturer is left with more LEDs that cannot be used for the display.

Figure 11:
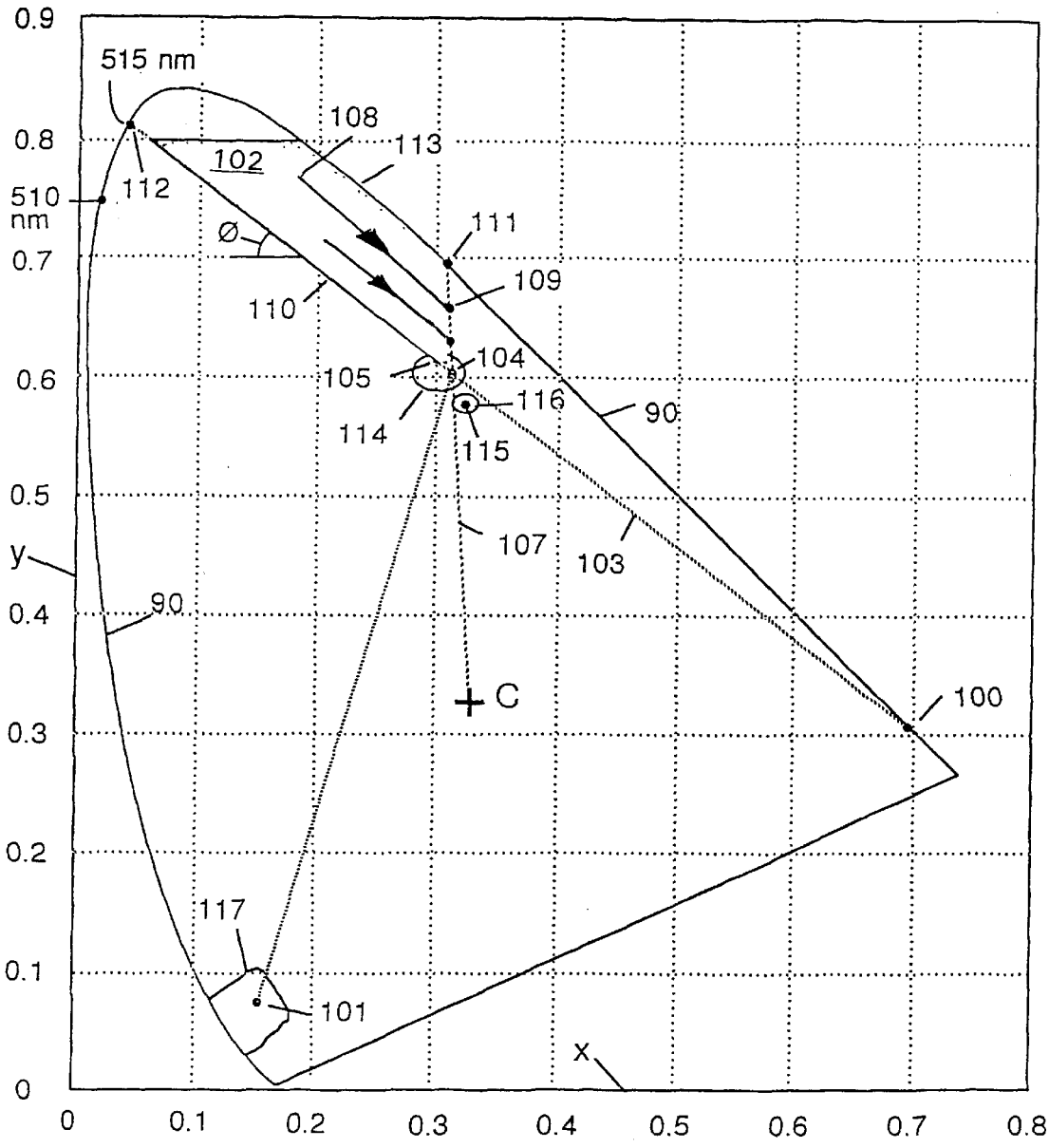
FIG. 11 illustrates color matching for the display.

FIG. 11 illustrates how green gallium nitride lamps can be used for RGB display with the present invention. It is assumed that the red lamps of the display are perfectly matched in color and have the color represented by point 100 and that that the blue lamps of the display are perfectly matched in color and have the color represented by point 101. Green GaN LEDs are a sorted from production output range 91, shown in FIG. 10, to provide selection 102 shown in FIG. 11. Selection area 102 has a first slanting boundary 113 which is part of the right hand side of locus 90, and a second slanting boundary 110. Boundary 110 is inclined to the x-axis by an angle Ø that is chosen to be between 20 and 60 degrees, and preferably between 25 and 45 degrees. More preferably still, boundary 110 coincides with a line 103 that joins point 100 on locus 90 to a point 112 on the top part of locus 90 corresponding to a wavelength greater than 510 nanometers, such as 515 nanometers. The length of boundary 110 is preferably greater than 0.1 and more preferably greater than 0.15. As illustrated in FIG. 11, boundary 110 is about 0.31 long. Selection 102 provides a larger proportion of LEDs used from the production output than selection 92 in FIG. 10. The lamps of area 102 may have blue-suppressing filters.

A point 104 on line 103 is chosen as a target reference color for color matching of the green LEDs. By color correction using red alone the appearance of a green LED having the color 108 is shifted to be at or near color 109 on dotted line 107. By the correction using red, all the LED colors in area 102 are shifted towards point 100 so as to be at or near the portion of line 107 that is above point 104, that is, all having dominant color 111.

By using blue as well as red more precise color correction can be achieved. The colors on line 107 above point 104 are shifted towards blue point 101 to fall into zone 114.

It is convenient to regard zone 114 as representing green first order "pseudo lamps". The green first order pseudo lamps represent the response of the display system to external requests for green. The size of area 104 is dependent on inaccuracies of color measurement during priming, as well as other factors. The first order pseudo lamps in zone 114 can themselves be matched by a secondary priming operation aimed at matching both the intensities and the colors of the the first order pseudo lamps. In the secondary priming operation the first order pseudo lamps are turned on one at a time or several at a time and measured for intensity and color so that they can be corrected. Referring to FIG. 11, it can be appreciated that the color of any first order pseudo lamp in zone 114 can be shifted towards a new color reference point 115 (using red 100, or both red 100 and blue 101) so as to be a more precisely colored, second order, pseudo lamp represented in a zone 116; zone 116 being even smaller than zone 114.

If the blue lamps are not matched as represented by point 101 but have a distribution 117, the blue lamps can be color matched using the red lamps of color 100 and pseudo green lamps.

The present invention is applicable to displays employing LEDs formed or supported on opaque or transparent sheets that are flexible or rigid, such as organic LEDs, as well as displays employing other types of LEDs.

Any combination of the various teachings herein can be used in a single display.

Information, such as Pr, Pg, Pb, specifying what a pixel is required to display is classified here as command information. Information or parameters relating to properties of the lamps, such G value, E value, B value, Zrg value, etc., is classified here as physical information.

What is claimed is:

1. A display system having a display matrix and comprising:

first LED-light sources within said matrix each for generating light of a first nominal color and each having a neighboring second LED-light source that is for generating light of a second nominal color, said first LED-light sources having differing actual colors of light generated;

memory associated with each of said first LED-light sources storing first information that is dependent on the actual color of light generated by the first LED-light source;

a control system comprising drivers for energising said first and second LED-light sources and arranged so that when display light of said first nominal color is required from any given one of said first LED-light sources the display light of that source is modified by a chance of the light from its said neighboring second LED-light source, said change of light being dependent on said first information for the first LED-light source and on the amount of said required display light; and said change of light serving to reduce apparent color mismatches in said matrix caused by said differing actual colors.

2. An LED display system according to claim 1 including memory storing for each of said first LED-light sources second information, said second information being dependent on the efficiency of the first LED-light source in generating light of said first nominal color.

3. An LED display system according to claim 1 wherein said first LED-light sources generate green light and said second LED-light sources generate red light.

4. A display system according to claim 3 including a matrix tile comprising said first and second LED-light sources.

5. An LED display system according to claim 3 wherein each of said first LED-light sources is provided with a filter for reducing bluish light.

6. An LED display system according to claim 3 wherein each of said first LED-light sources is provided with a yellow colored filter.

7. An LED display system according to claim 3 wherein each of said first LED-light sources is provided with a filter so as to increase the dominant color wavelengths of at least some of said first LED-light sources by more than 3 nanometers.

8. An LED display system according to claim 3 wherein said first LED-light sources are selected to have colors on the CIE 1931 (x, y) chromaticity diagram represented by an area on the diagram having first and second slanting boundaries, said first slanting boundary being nearer to the right hand side of the spectrum locus of the chromaticity diagram than said second slanting boundary and said second slanting boundary being inclined to the x-axis of the diagram by an angle Ø greater than 20 degrees and less than 60 degrees.

9. An LED display system according to claim 8 wherein Ø is between 25 and 45 degrees.

10. An LED display system according to claim 8 wherein said area is to the right of a line that joins the 510 nm point on the CIE spectral locus to a point on the locus representing a red color.

11. An LED display system according to claim 8 wherein said area is to the right of a line that joins the 515 nm point on the CIE spectral locus to a point on the locus representing a red color.

12. An LED display system according to claim 8 wherein said second slanting boundary is at least 0.15 long.

13. An LED display system according to claim 1, wherein said second LED-light source comprises a plurality of separately operable light emitters.

14. An LED display system according to claim 1 comprising a microprocessor, a single bit memory element, and a transistor driving one of said second LED-light sources; said single bit memory element receiving a serial data stream from said microprocessor and driving said transistor.

15. A display system according to claim 1 that substantially reduces apparent color mismatches in said matrix caused by said differing actual colors when images of only said first nominal color are displayed.

16. A display system according to claim 1 wherein for of each said first LED-light source the drive to the first LED-light source is adjusted so as to at least partly compensate for apparent change of brightness of the first LED-light source caused by said change of light.

17. A display system according claim 1 including means for assessing for each of said second LED-light sources the drop in its light output caused by change of its internal temperature.

18. A display system according to claim 1 wherein said first information is derived using a camera.

19. A display system according to claim 1 wherein said first information is altered by a repriming operation during the service life of the display matrix.

20. A display system according to claim 1 relying on a second order pseudo lamps.

21. A display system according to claim 1 wherein at least one of said first and second LED-light sources is an organic LED.

22. A display system comprising:

an array of LED-light sources for producing at least part of a displayed image, said array including first LED-light sources each for generating light of a first nominal color and each having an associated second LED-light source that is for generating light of a second nominal color, said first LED-light sources having differing actual colors of light generated;

memory associated with each of said first LED-light sources storing first information that is dependent on the actual color of light generated by the first LED-light source;

a control system comprising drivers for energizing said first and second LED-light sources and arranged so that when display light of said first nominal color is required from any given one of said first LED-light sources the display light of that source is modified by a change of the light from its said neighboring second LED-light source, said change of light being dependent on said first information for the first LED-light source and on the amount of said required display light; and said change of light serving to reduce apparent color mismatches in said matrix caused by said differing actual colors.

23. A display system according to claim 22 including a set LEDs that:

are of the same nominal color;

have differing LED junction temperatures; and exhibit light change due to change of LED junction temperature; and wherein said control system reduces mismatch in the light intensities of the LEDs of the set caused by said differing LED junction temperatures.

24. A display system according to claim 23 wherein said control system measures, for each of the LEDs of said set individually one of the current through the LED and the voltage drop across the LED.

25. A display system according to claim 23 wherein said first LED-light sources comprise organic LEDs.

26. A display according to claim 23 wherein said first information is derived by measuring light that is modulated by a signal and measured by an arrangement that is selective to that signal.

27. A display system having a display matrix and comprising:

first LED-light sources within said matrix each for generating light of a first nominal color and each having a neighboring second LED-light source that is for generating light of a second nominal color, said first LED-light sources having differing actual colors of light generated;

memory associated with each of said first LED-light sources storing first information that is dependent on the actual color of light generated by the first LED-light source;

means providing for each of said second LED-light sources temperature-dependent information related to the change in the light output of the second LED-light source caused by a change of its individual internal temperature;

a control system comprising drivers for energising said first and second LED-light sources and arranged so that for each of said second LED-light sources the drive to the second LED-light source is dependent on its temperature-dependent information and on the first information of a neighboring first LED-light source; and said control system reducing apparent color mismatches in said matrix that are caused by said differing actual colors.

28. A display system according to claim 27, wherein said temperature-dependent information is derived using an analogue-to-digital converter.

29. A display system according to claim 27 wherein said temperature-dependent information is derived from measurements of one of the currents and the voltages of said second LED-light sources.

30. A display system having a display matrix and comprising:

first LED-light sources each for generating light of a first nominal color and each having a neighboring second LED-light source that is for generating light of a second nominal color, said first LED-light sources having differing actual colors of light generated;

memory associated with each of said first LED-light sources storing first information that is dependent on the actual color of light generated by the first LED-light source;

a device for providing digital calculations;

a control system comprising drivers for energising said first and second LED-light sources and arranged so that when display light of said first nominal color is required from any given one use of said first LED-light sources the display light of that source is accompanied by a change of light from its said neighboring second LED-light source, the amount of said change of light being derived using said device and said first information for the first LED-light source; and said change of light reducing apparent color mismatches in said matrix caused by said differing actual colors.

31. A display system according to claim 30 wherein said device comprises a microprocessor that computes the amount of said change of light.

32. A display system according to claim 30 including a matrix tile comprising said first and second LED-light sources.

33. A display system having a display matrix and comprising:

first LED-light sources within said matrix each for generating light of a first nominal color and each having a neighboring second LED-light source that is for generating light of a second nominal color, said first LED-light sources having differing actual colors of light generated;

memory associated with each of said first LED-light sources storing first information that is dependent on the actual color of light generated by the first LED-light source;

a control system comprising drivers for energizing said first and second LED-light sources and arranged so that when display light of said first nominal color is required from any given one of said first LED-light sources the display light of that source is modified by a change of the light from its said neighboring second LED-light source, said change of light being dependent on said first information for the first LED-light source; and said change of light serving to reduce apparent color mismatches between said first LED-light sources caused by said differing actual colors.

34. A display system according to claim 1 comprising a translucent sheet through which light from said first LED-light sources passes.

35. A display system according to claim 1 wherein at least one of said first LED-light sources and said second LED-light sources comprises organic LEDs.

36. A display system according to claim 1 wherein the first information for a first LED-light source is derived by measurement of the color of light from that source.

* * * * *

Disclaimer

6,329,758 B1—Hassan Paddy Abdel Salam, London (GB). LED MATRIX DISPLAY WITH INTENSITY AND COLOR MATCHING OF THE PIXELS. Patent dated December 11, 2001. Disclaimer filed July 22, 2014, by the inventor.

Hereby disclaim complete claims 1-36, of said patent.

(*Official Gazette, February 24, 2015*)